US010508481B2

(12) United States Patent
Robertson

(10) Patent No.: US 10,508,481 B2
(45) Date of Patent: Dec. 17, 2019

(54) ENERGY EFFICIENT AND POWER VERSATILE ELECTRO-PERMANENT MAGNET SYSTEM FOR USE IN A DOOR HOLDER UNIT

(71) Applicant: Glen A. Robertson, Madison, AL (US)

(72) Inventor: Glen A. Robertson, Madison, AL (US)

( * ) Notice: Subject to any disclaimer, the term of this patent is extended or adjusted under 35 U.S.C. 154(b) by 201 days.

(21) Appl. No.: 15/844,588

(22) Filed: Dec. 17, 2017

(65) Prior Publication Data

US 2019/0186181 A1 Jun. 20, 2019

(51) Int. Cl.

| | |
|---|---|
| ***E05C 17/56*** | (2006.01) |
| ***H01F 7/02*** | (2006.01) |
| ***H01F 7/16*** | (2006.01) |

(52) U.S. Cl.

CPC ..... *E05C 17/56* (2013.01); *H01F 7/021* (2013.01); *H01F 7/1646* (2013.01); *H01F 2007/1669* (2013.01)

(58) Field of Classification Search

CPC ..... E05C 17/56; H01F 7/1646; H01F 7/021; H01F 2007/1669

USPC ..... 361/144

See application file for complete search history.

(56) References Cited

U.S. PATENT DOCUMENTS

| | | | | |
|---|---|---|---|---|
| 4,439,808 A * | 3/1984 | Gillham | E05C 19/168 | 292/144 |
| 4,580,136 A * | 4/1986 | Kitamura | G07C 9/00182 | 340/12.22 |
| 4,682,801 A * | 7/1987 | Cook | E05C 19/166 | 292/251.5 |
| 5,000,018 A * | 3/1991 | Eisermann | E05B 47/068 | 70/223 |

* cited by examiner

*Primary Examiner* — Dharti H Patel

(57) ABSTRACT

An energy efficient and power versatile electro-permanent magnet system for use in a door holder unit is an electro-permanent magnet having a permanent magnet for holding a door open while unpowered and a control coils that can be pulsed powered, locally or remotely, by a pulsed capacitor control circuit for power versatility and for releasing of the door with little energy.

16 Claims, 7 Drawing Sheets

FIG 2
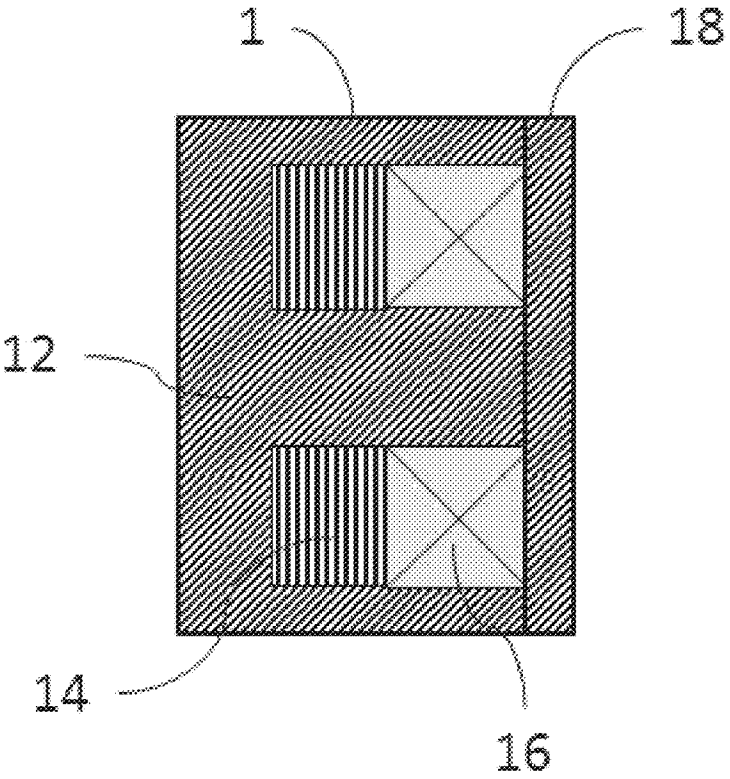
FIG 2b
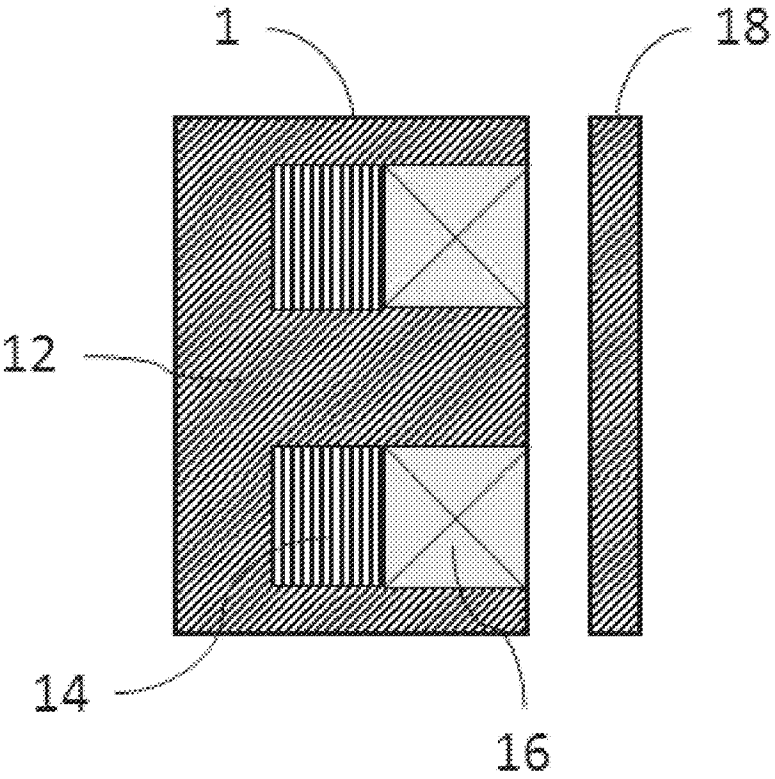
FIG 2a

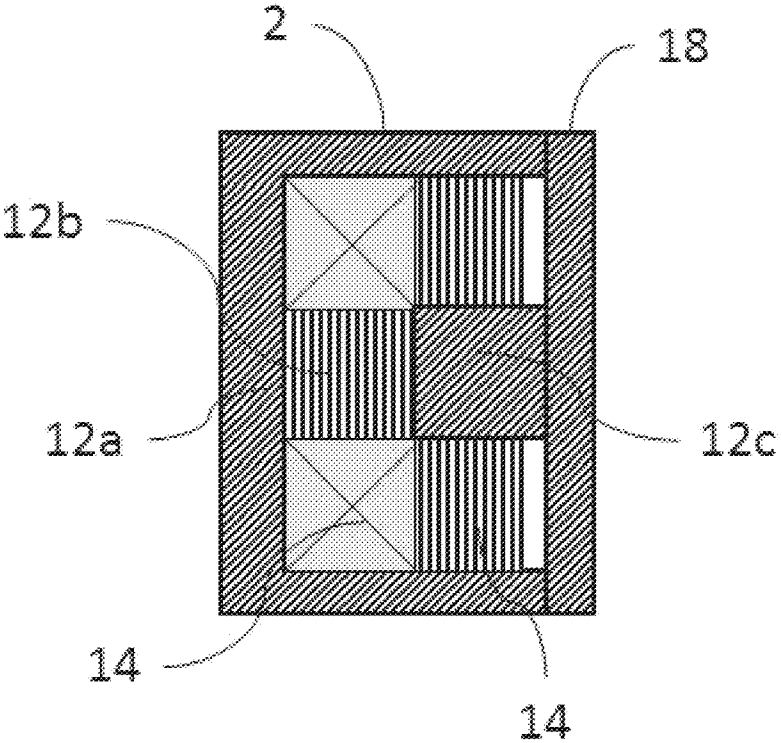
FIG 3b
FIG 3
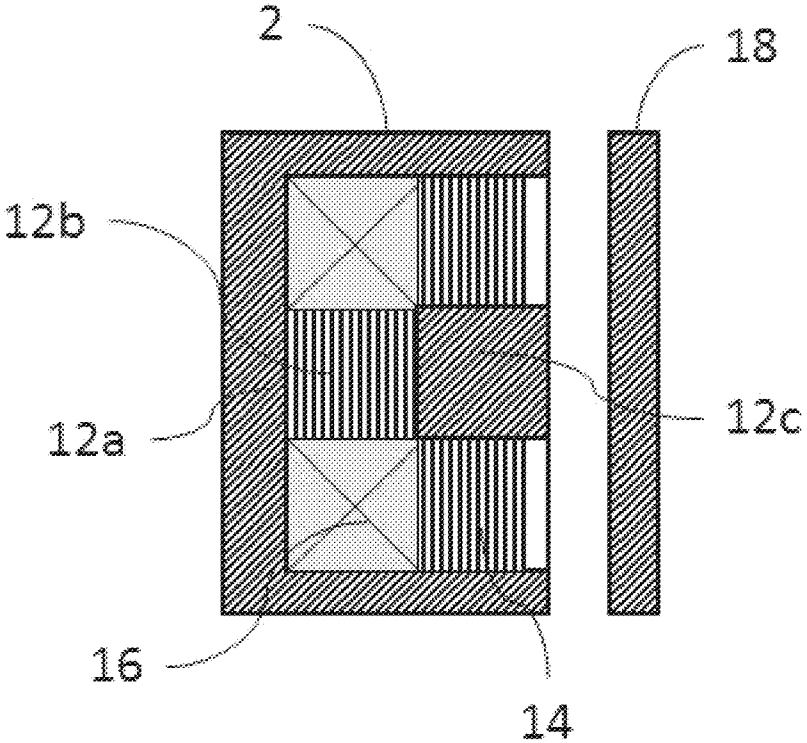
FIG 3a

FIG 4
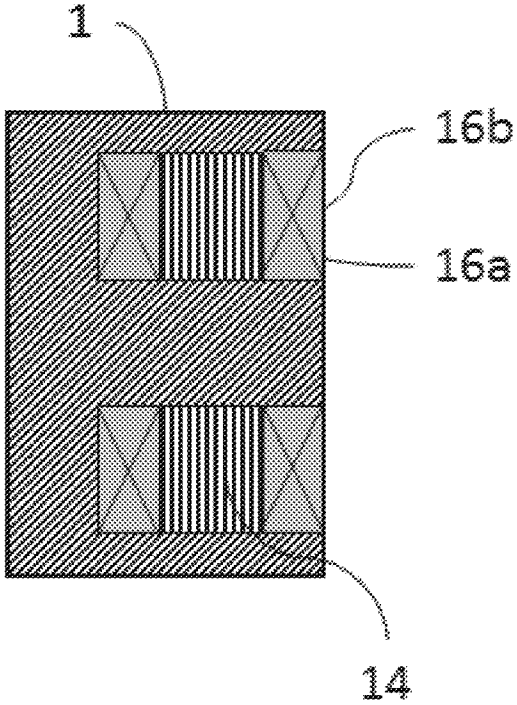
FIG 4c
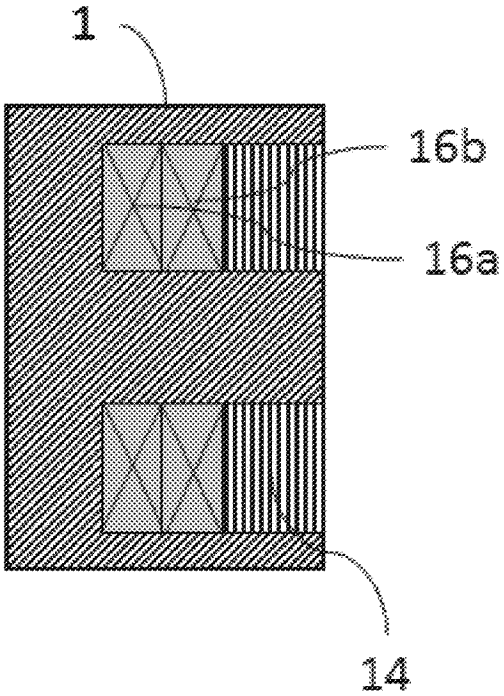
FIG 4b
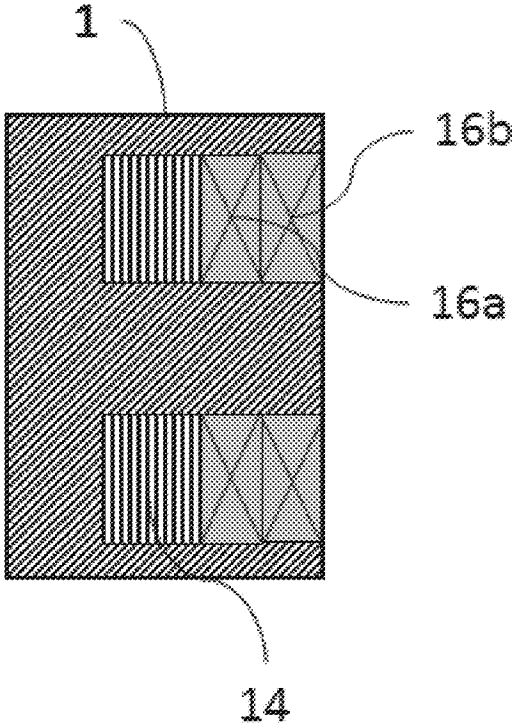
FIG 4a

FIG 5
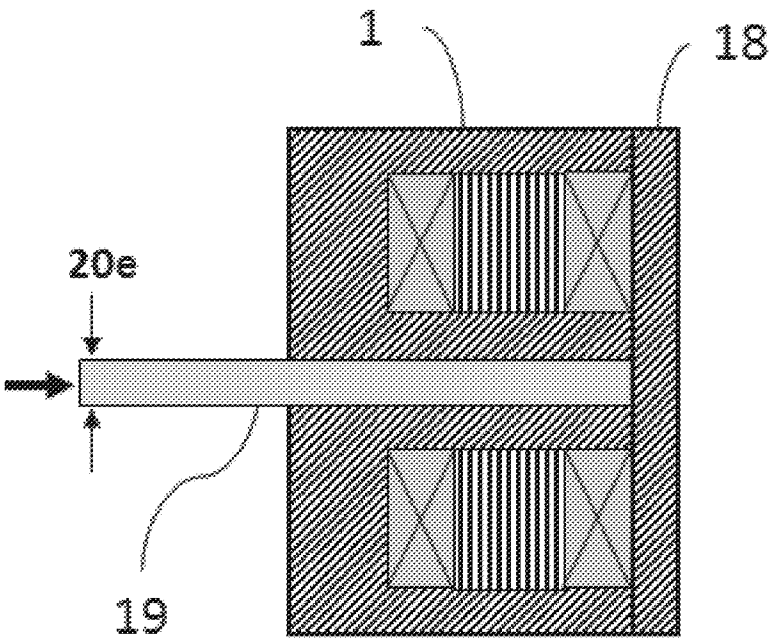
FIG 5b
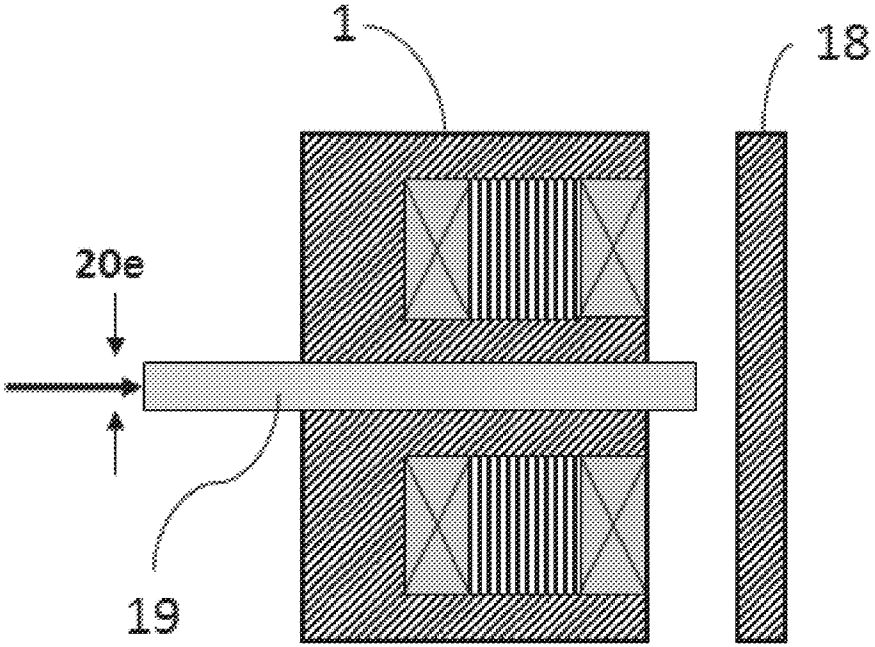
FIG 5a

ENERGY EFFICIENT AND POWER VERSATILE ELECTRO-PERMANENT MAGNET SYSTEM FOR USE IN A DOOR HOLDER UNIT

TECHNICAL FIELD

This invention relates to the replacement of the electromagnet in electromagnetic door holding devices, and more particularly to a door holding electro-permanent magnet system for magnetically maintaining a door in an open position without power for energy efficiency, and powered and controlled by a pulsed capacitor control circuit for power versatility and releasing of the door with little energy, locally or remotely.

BACKGROUND ART

In many situations, it is desirable to hold a door in an open position. Devices for this purpose may be utilized with automatic closing features which are used for remotely closing a door when a condition, for example, such as smoke or fire is present and it is desired that a particular entry way be secured. Previously developed door holding devices with automatic closing have utilized electromagnets that are powered continuously during the holding of the door in the open position with the power remotely turn-off to the electromagnet during closed-door periods, which can be short compared to the open-door periods.

In today's more energy efficient buildings, holding multiple doors open 24/7, when using such electromagnets, can over time become a major energy draw for the building's power management system. Thus, a need has arisen for a door holding electromagnet to be unpowered during the holding of the door in the open position to eliminate the continuous power draw on the building's power management system.

Further building power management systems are increasingly converting to green energy, as solar power, to reduce the carbon foot-print of the building. Green energy mechanisms typically have low power inputs that either have to be stored over time before power conversion can be made or the green energy systems have to be large, both can be complex. Thus, a need has arisen for a door holding electromagnet to be powered and controlled by a power versatile circuit to reduce the complexity of the green energy system used by a building's power management system.

Door holding electromagnets are widely used in existing buildings and other facilities. Therefore, there is a need for an energy efficient and power versatile door holding electromagnet that does not substantially change the foot-print of the existing door holding electromagnet system that is being replaced.

DISCLOSURE OF THE INVENTION

In accordance with the present invention, a door holding electro-permanent magnet system is provided that: is energy efficient for substantially reducing the continuous power draw on a building's power management system, is power versatile for green energy application, and does not substantially change the foot-print of existing door holding electromagnet system that is being replaced. This is accomplished by using electromagnets containing permanent magnets of the type that are called, in this specification, as an electro-permanent magnet or EPM.

In this specification, two types of EPMs are presented. The first type of EPM will be referred to as a two-permanent magnet EPM or 2PM-EPM and the other will be referred to as a bi-stable EPM or BS-EPM.

In the 2PM-EPM, the permanent magnet consists of two sections, one is a high coercivity permanent magnet and one is a low coercivity permanent magnet. The low coercivity permanent magnet is part of the central pole of the magnetic core and the high coercivity permanent magnet is about the non-low coercivity permanent magnet portion of the central pole of the core. The direction of magnetization in the high coercivity permanent magnet can be switched by a pulse of current through a control coil about the low coercivity permanent magnet. When the control coil is not under a pulsed current, the directions of magnetization of the low and high coercivity permanent magnet is aligned, the central pole of the core produces an external magnetic field at its open pole to allow attraction of a magnetic material, and when the control coil is under a pulsed current, the low and high coercivity permanent magnets have opposing magnetizations, the core then produces no net external field at its open pole to allow the release of the magnetic material.

In the BS-EPM, there is a single permanent magnet and one or more control coils placed about the central pole of the magnetic core and has similarity to U.S. Pat. No. 3,022,450 and more specifically to U.S. Pub. No. 2013/0328650. The permanent magnet's placement is near the center of the core with the one or more control coils place adjacent to the permanent magnet. When a magnetic material is placed at the open pole end of the core, the magnetic flux from the permanent magnet is in a bi-stable state between the magnetic material at the open end of the core and the closed end of the core. By switching a pulse of current through the one or more control coils, more magnetic flux can be diverted in one direction than the other, to either increase or decrease the magnetic force at its open pole to either attract or release the magnetic material.

In both EPMs, the permanent allows for holding the magnetic material under no power verse the continuous current application done in prior art door holding electromagnets. Whereby, when the magnetic material is an attractive plate in a plate fixture attached to a door and the EPM is in a door holding unit attached to say a wall, a door can be held open under no power to provide an energy efficient means for holding open a door. Further, it has been demonstrated that these EPMs can be fabricated to the same or smaller dimension to existing door holding electromagnets, allowing direct replacement thereof.

To allow the EPMs to be power versatile requires that the pulse of current through the control coil to release the attractive plate be from a capacitively pulsed power system, such that the time the that the majority of the current is applied to the control coil of the EPM is mostly controlled by the power in a capacitor, where shorting of the pulse time can be controlled with a control circuit. One such mean specially design for EPMs is the bi-stable permanent magnet actuator system or BSPMAS of U.S. Pat. No. 9,343,216.

The BSPMAS includes a power source, voltage conditioner, an energy storage capacitor, and a control circuit, which can be a microcomputer that controls several electronic switches. By placing the power source, voltage conditioner, and control circuit external to the door holding unit containing the EPM, which could be within a building's energy management system at a remote location, the addition of the energy storage capacitor and electronic switches has been demonstrated to not change the size or shape of the existing door holding unit.

Therefore, the application of the invention having an EPM and BSPMAS together to from a door holding electro-permanent magnet system will not impact the foot-print of existing door holding units.

It has also been demonstrate that the voltage conditioner in a BSPMAS can be a DC-DC boost powered from a 5V-USB or 5V directly from a computer to allow the present invention to be easily merge into a building's energy management system.

BRIEF DESCRIPTION OF THE DRAWINGS

For a more complete understanding of the present invention and for further advantages thereof, reference is now made to the following Detailed Description taken in conjunction with the accompanying Drawings in which:

FIG. 2 shows a perspective BS-EPM of the present invention with the attractive plate in the unlatched position in FIG. 2*a,* and the magnetically latched position in FIG. 2*b;*

FIG. 3 shows a perspective 2PM-EPM of the present invention with the attractive plate in the unlatched position in FIG. 3*a*, and the magnetically latched position in FIG. 3*b;*

FIG. 4 shows the BS-EPM of the present invention with dual control coils, where FIGS. 4*a-c* show different placements of the dual control coils;

FIG. 5 shows the addition of a perspective proximity sensor system to the BS-EPM of FIG. 2;

DETAILED DESCRIPTION

Referring to FIGS. 1-7, which are shown to facilitate the features of the present invention.

Figure 1:
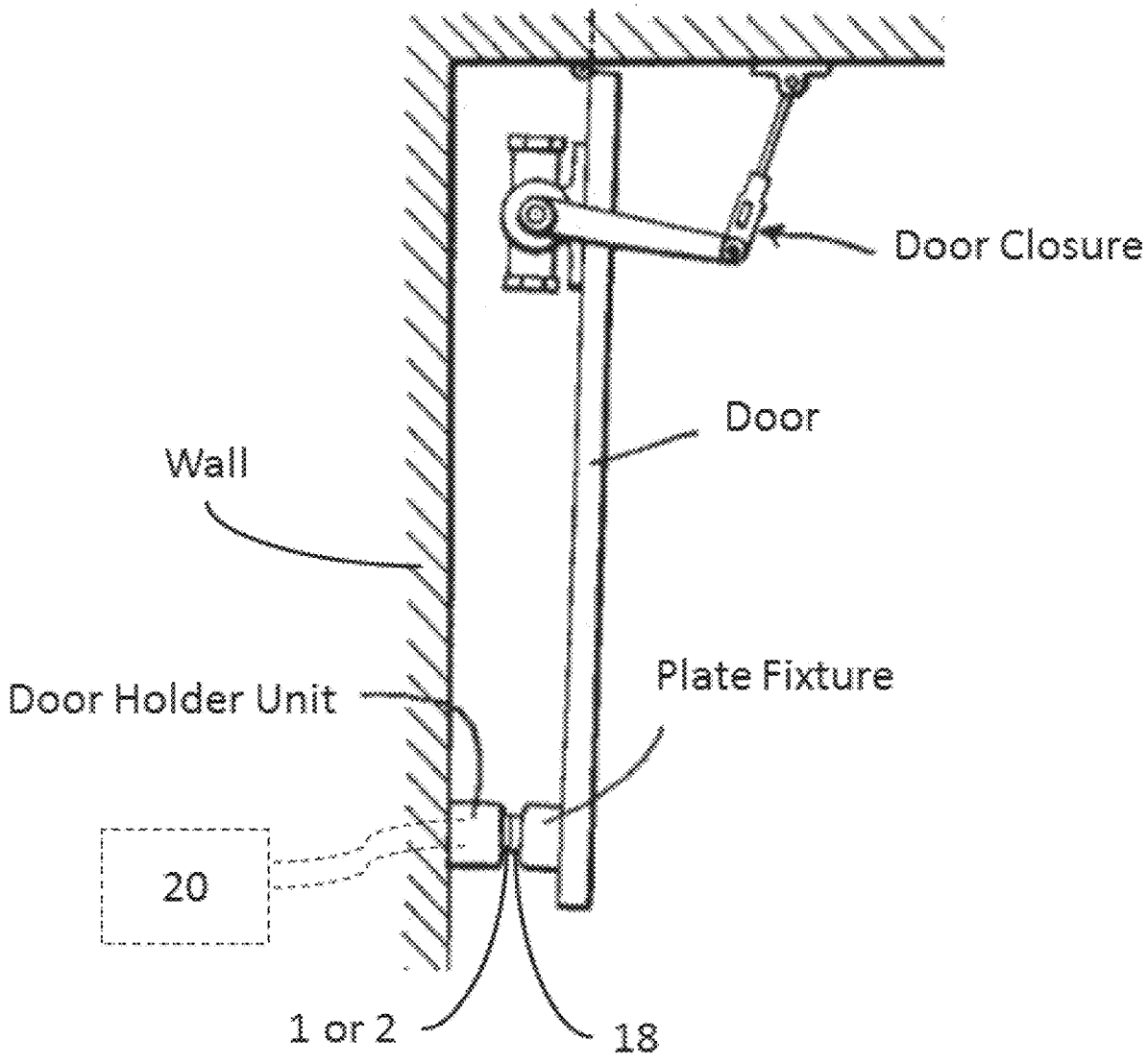
FIG. 1 shows an illustration of a door being held open by a door holding unit and plate fixture disposed between a wall and a door, incorporating the present invention.

FIG. 1 is a drawing to illustrate the present invention containing a BS-EPM 1 or 2PM-EPM 2 and a power versatile power and control method 20 (represented by the dash box and lines) for use in a "Door Holder Unit" attached to a "Wall" for maintaining a "Door" in an open position under no power by magnetically attracting and holding an attractive plate 18 in a "Plate Fixture" attracted to the "Door", where when the power and control method 20 sends a pulsed current to one or more control coils in the BS-EPM 1 or 2PM-EPM 2, the attractive plate is released to allow the "Door Closure" to pull the "Door" away from the "Door Holder Unit", closing the "Door" (not shown).

The preferred power and control method 20 is a modification of the BSPMAS of U.S. Pat. No. 9,343,216, which is a power versatile capacitor pulsed power and control system, and will hereafter be referred to as the BSPMAS 20.

In FIG. 1, the BS-EPM 1 or 2PM-EPM 2 and all or part of the BSPMAS 20 of the present invention replaces the electromagnet in prior art "Door Holder Units." The attractive plate 18 is mounted to the "Plate Fixture," where as in the art of electromagnetic door holders, the "Plate Fixture" allows the attractive plate 18 to mate with and magnetically latch to the BS-EPM 1 or 2PM-EPM 2 in the "Door Holder Unit". The BS-EPM 1 or 2PM-EPM 2 in the "Door Holder Unit" is magnetically active under no power as they contain permanent magnets to hold against the force of the "Door Closure." Whereby, the force applied by the "Door Closure" pulls the "Door" away from the "Door Holder Unit" only when the BS-EPM 1 or 2PM-EPM 2 is rendered less magnetic when a pulsed current is sent to the control coil 16 by the BSPMAS 20.

It is understood that the pulsed current sent to the control coil 16 by the BSPMAS 20 is through wires that will not be shown in this specification as it is well understood by those skilled in the art of electromagnets.

It is further understood that the construct of the "Door Holder Unit," "Plate Fixture," "Door Closer," "Wall" and "Door" will not be further presented in this specification as they are numerous and well understood by those skilled in the art electromagnetic door holders.

It is still further understood that the in the art of electromagnetic door holders, the "Door Holder Unit" is not limited to being mounted to a wall.

FIG. 2 is a drawing of the BS-EPM 1, having similarity to the electro-permanent magnet in U.S. application 2013/0328650, with the attractive plate 18 unlatched in FIG. 2*a* and the attractive plate 18 magnetically latched in FIG. 2*b*. The BS-EPM 1 is composed of an iron or likewise magnetic core 12 as known in the art of electromagnets; a permanent magnet 14; and control coil 16.

FIG. 3 is a drawing of the 2PM-EPM 2 with the attractive plate 18 unlatched in FIG. 3*a* and the attractive plate 18 magnetically latched in FIG. 3*b*. The 2PM-EPM 2 is composed of a magnetic core 12, compose of three parts—an iron or likewise magnetic core 12*a* and 12*c* as known in the art of electromagnets and a low coercivity permanent magnet 12*b;* a high coercivity permanent magnet 14; and control coil 16.

It is understood that the permanent magnet 14 in FIG. 2 and FIG. 3 will produce magnetic flux at the open pole of the magnetic core 12 to attract and magnetically latched or hold the attractive plate 18 to the BS-EPM 1 in FIG. 2*b* and the EPM 2 in FIG. 3*b* without power applied to the control coil 16.

FIG. 4 is a drawing showing the control coil 16 of the BS-EPM 1 of FIG. 2 divided into two control coils 16*a* and 16*b*. Dividing the control coil into two parallel connected control coils allows the voltage applied by the BSPMAS 20 to be lower than for a single coil improving the power versatility of the BSPMAS 20.

It is understood that the control coil 16 can be divided into multiple parallel connected coils to allow the voltage applied by the BSPMAS 20 to be even lower to further improve the power versatility of the BSPMAS 20.

It is also understood that the control coil 16 in the 2PM-EPM 2 can also be divided into multiple parallel connected coils.

FIG. 4 also shows various placement of the control coils 16*a* and 16*b* in the BS-EPM 1. In FIG. 4*a*, the control coils 16*a* and 16*b* are adjacent to the outward core side of the permanent magnet 14, in FIG. 4*b* the control coils 16*a* and 16*b* are adjacent to the inward core side of the permanent magnet 14, in FIG. 4*b* the permanent magnet 14 is between the control coils 16*a* and 16*b*. There is no preferred placement, but placement can help adjust the magnetic holding force due to the differences in magnetic flux leakage. Further, in FIG. 4*c*, the control coils 16*a* and 16*b* can be independently controlled for better control of the magnetic flux from the permanent magnet.

FIG. 5 is a drawing of the BS-EPM 1 of FIG. 2 to demonstrate one method to trigger a proximity sensor 20*e,* represented by the two small arrows, and trigger the BSPMAS 20 when to send a pulsed current to the control coil 16 of the BS-EPM 1 to aggressively attract plate 18 by causing more of the magnetic flux from the permanent magnet to be diverted toward the attractive plate 18.

It is understood that there are many different methods to trigger a sensor without taken from the intent of this embodiment of the present invention.

In FIG. 5, a member 19 free to move through the center of the BS-EPM 1 of FIG. 4*c* is added. In FIG. 5*a*, the member 19 is forced toward the attractive plate 18 by a return mechanism indicated by the large arrow, whereby the member 19 does not trigger the proximity sensor 20*e* indicated by the two small arrows. In FIG. 5*b*, the member 19 is pushed inward by the attractive plate 18 as the attractive plate 18 nears the BS-EPM 1, whereby the return mechanism is changed indicated by the short large arrow by the movement of the member 19 and triggers the proximity sensor 20*e* indicated by the member 19 coming between the two small arrows.

It is understood that the return mechanism indicated by the large arrow can be any mechanism, such as a spring, that can return the member 19 and the proximity sensor indicated by the two small arrows to an un-triggered state.

It is further understood that the proximity sensor 20*e* indicated by the two small arrows can be any type sensor that can be triggered by the member 19, such as an optical or mechanical switch.

It is still further understood that the member 19 must be designed to match the proximity sensor 20*e* and return mechanism.

It is also understood that the sensor and triggering method in FIG. 5 can also be used with a 2PM-EPM 2.

Figure 6:
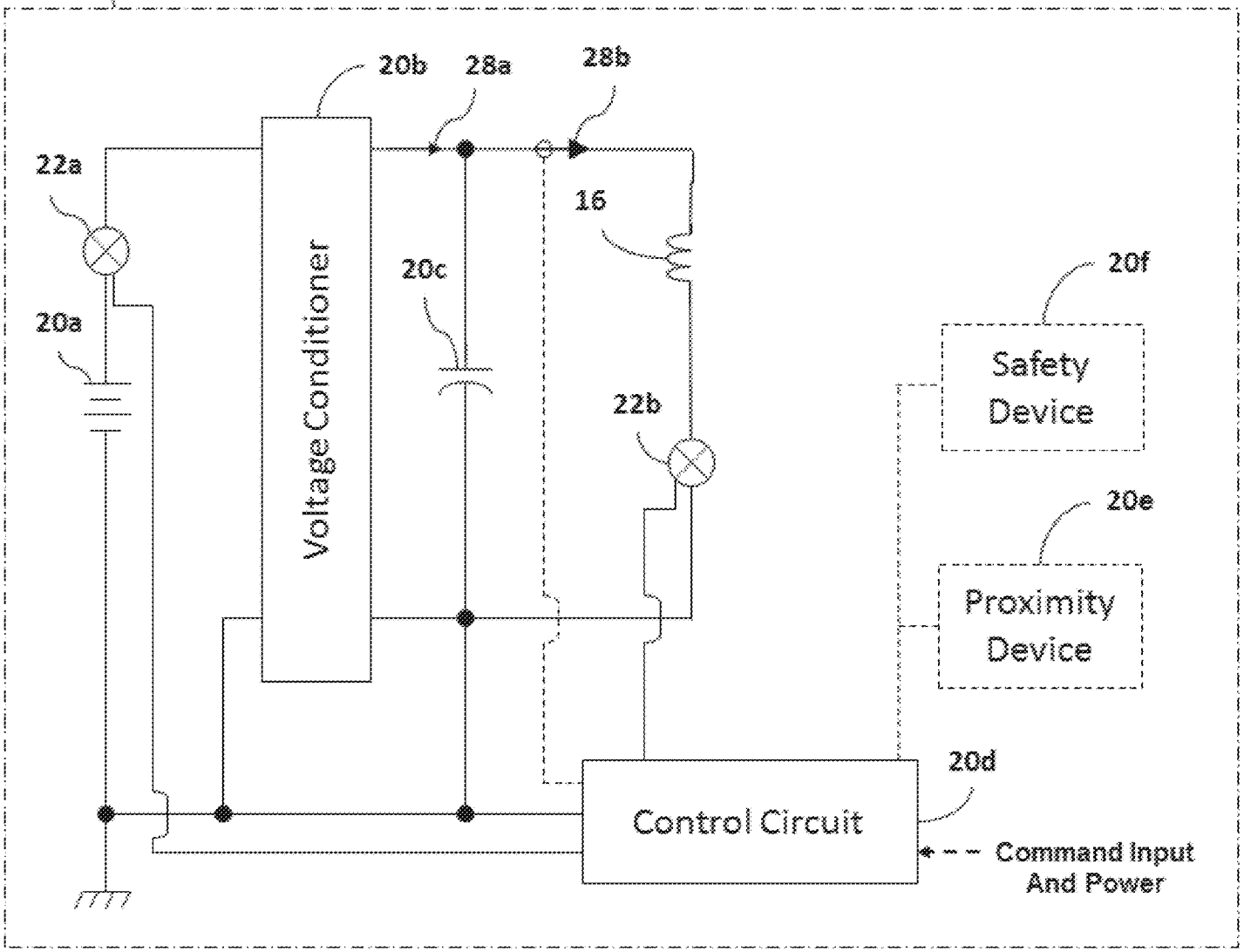
FIG. 6 shows a prospective schematic of a BSPMAS to send a pulse current to a single control coil in the present invention.
Figure 7:
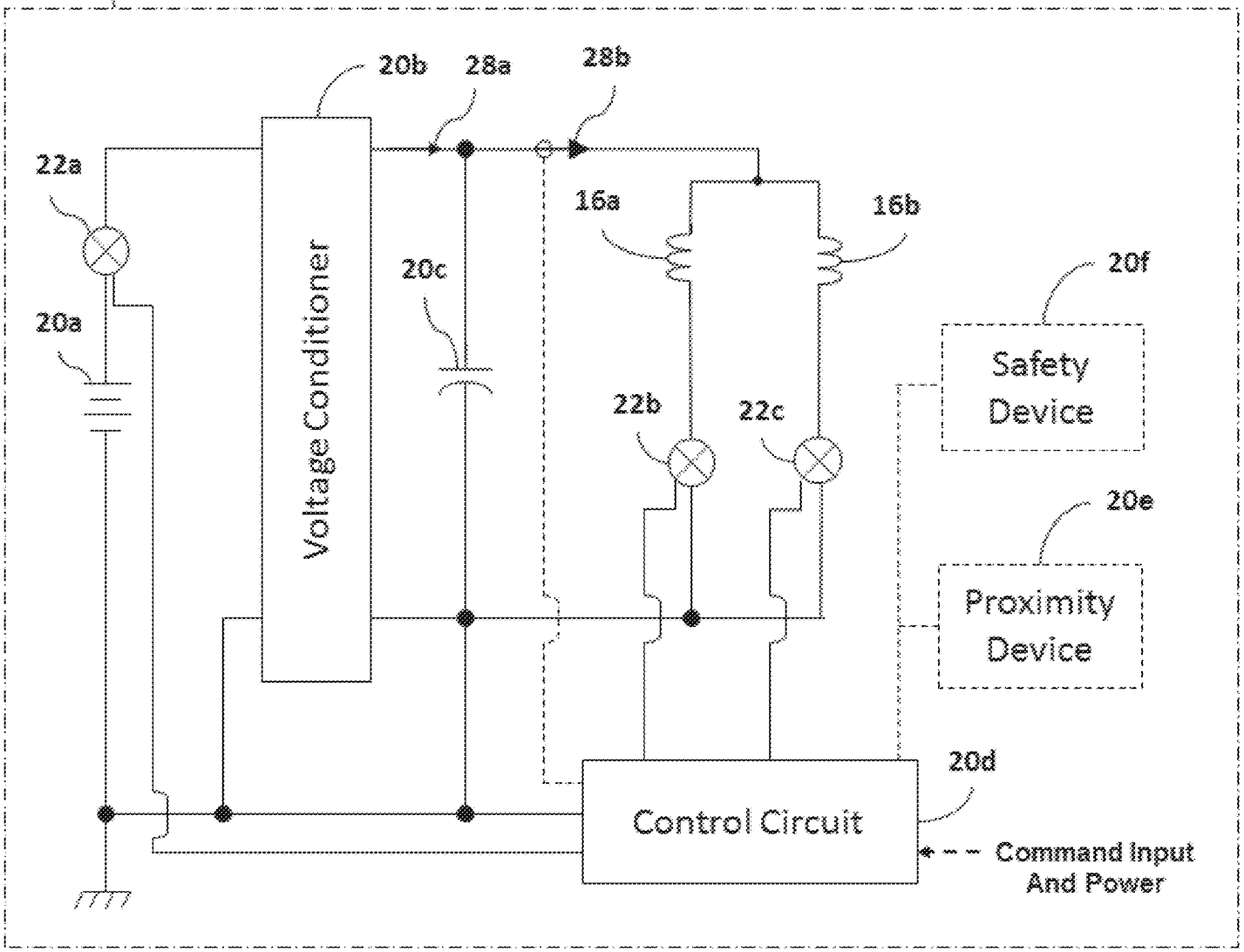
FIG. 7 shows a prospective schematic of a BSPMAS to send a pulse current to dual control coils independently in the present invention.

FIG. 6 and FIG. 7 are simple block diagrams of prospective BSPMAS 20 for power and control of the BS-EPM 1 or 2PM-EPM 2.

It is understood that other power versatile, power and control methods can be used without taking away from the present invention.

In FIG. 6 and FIG. 7, the block diagrams shown are variations on the BSPMAS circuit of FIG. 2 in U.S. Pat. No. 9,343,216 to power and control the pulse current to the coil 16 in the BS-EPM 1 or 2PM-EPM 2. FIG. 7 is the BSPMAS 20 of FIG. 6 with the addition of the switch 22*c* to allow the BSPMAS 20 to control coils 16*a* and 16*b* in FIG. 4 independently.

In FIG. 6 and FIG. 7, the BSPMAS 20 comprises a power source 20*a*, voltage conditioner 20*b*, an energy storage capacitor 20*e*, and a control circuit 20*d*. The switches 22*a* and 22*b* in FIG. 6 and FIG. 7 and switch 22*c* in FIG. 7 are controlled by the control circuit 20*d*. The dashed line from the control circuit 20*d* to between the arrows 28*a* and 28*b* infer an option for monitoring of the voltage on the storage capacitor 20*c* by the control circuit 20*d*. The small arrow 28*a* infers the charge current to the storage capacitor 20*c* from the voltage conditioner 20*b*. The large arrow 28*b* infers the discharge current to the control coil 16 of the BS-EPM 1 or 2PM-EPM 2 from the storage capacitor 20*c*.

The control circuit 20*d* is the heart of the BSPMAS 20 as it controls the power input through switch 22*a* and the pulse current 28*b* from the storage capacitor 20*c* to the control coil 16 through switch 22*b* in FIG. 6 and FIG. 7 or switch 22*e* in FIG. 7 of the BS-EPM 1 or 2PM-EPM 2. The "Command Input" to the control circuit 20*d* can be of various remote or manual means as known in the art of control circuits to start the operation of the BSPMAS 20.

It is understood that the control circuit 20*d* could be a microcontroller programed to perform the functions needed to control the BS-EPM 1 or 2PM-EPM 2.

Further it is understood that other control methods as simple mechanical switches can be used without taking away from the present invention, whereby the "Command Input" could be a person operating the switches.

In FIG. 6 and FIG. 7, the options indicated by the dash lines and boxes are shown for a proximity device 20*e* to aggressively attract the attractive plate 18, and for a safety device 20*f* to release the attractive plate 18 by telling the control circuit 20*d* to turn on switches 22*a* and 22*b* or 22*c*.

It is understood that the safety devices 20*f* can be a heat or smoke detector, thereby to automatically secure an area which is accessible through the "Door" of FIG. 1.

Using the BSPMAS 20 as shown in FIG. 6 or FIG. 7, the operation to charge the capacitor 20*c* is as follows: the "Command input" tells the control circuit 20*d* to close the power switch 22*a* to allow power (voltage and current) from the power input 20*a* to the voltage conditioner 20*b*, which either bypasses the power directly to the capacitor 20*c* or first converts the power's voltage to the predetermined voltage—needed for the control coil 16 in FIG. 6 or the control coil s 16*a* and 16*b* in FIG. 7 prior to sending the power to the capacitor 20*c*. The charging current to the capacitor 20*c* is indicated by the small arrow 28*a*. Once the close command is sent to the power switch 22*a*, the control circuit 20*d* either monitors the voltage on the capacitor 20*c* (indicated by the dash line) or begins a first count to allow the capacitor 20*c* to charge to the predetermined voltage. After the predetermined voltage is attained, the control circuit 20*d* may open the power switch 22*a* or maintain a trickle charge to the capacitor 20*c* by periodically turning the power switch 22*a* on and off.

It is understood that the initial current from the power input 20*a* may also change going through the voltage conditioner 20*b*.

It is further understood that charge will also flow to the control coil 16 in FIG. 6 or the control coils 16*a* and 16*b* in FIG. 7. However, the control coil 16 in FIG. 6 or the control coils 16*a* and 16*b* in FIG. 7 can only store the charge while the switches 22*b* and 22*c* are off.

Using the BSPMAS 20 as shown in FIG. 6 or FIG. 7, the operation to release the attractive plate 18 from the BS-EPM 1 of FIG. 2*a* or FIG. 5*b* or the EPM 2 of FIG. 3*a* is as follows: the "Command Input" or a safety device 20*f* tells the control circuit 20*d* to close the power switch 22*b* in FIG. 6 or FIG. 7 to allow current to be discharged from the storage capacitor 20*c*—indicated by the large arrow 28*b*—through the control coil 16 in FIG. 6 or the control coil 16*a* in FIG. 7 causing the magnetic flux to the attractive plate 18 to be greatly reduced to allow the "Door Closure" in FIG. 1 to pull the attractive plate 18 off the BS-EPM 1 or 2PM-EPM 2 and close the "Door" of FIG. 1.

Using the BSPMAS 20 as shown in FIG. 7 with reference to FIG. 4 and FIG. 5, the operation to aggressively attract the attractive plate 18 to the BS-EPM 1 of FIG. 5 is as follows: the "Command Input" or a proximity device 20*e* tells the control circuit 20*d* to close the power switch 22*c* in FIG. 7 to allow current to be discharged from the storage capacitor 20*c*—indicated by the large arrow 28*b*—through the control coil 16*b* in FIG. 7 causing the magnetic flux to the attractive plate 18 to be greatly increased to attract the attractive plate 18 to the BS-EPM 1 and hold open the "Door" of FIG. 1.

The time that the current flows through the control coil 16 in FIG. 6 or the control coils 16*a* or 16*b* in FIG. 7 can be controlled by a second count performed by the control circuit 20*d*. At end of the second count, the control circuit 20*d* opens the switch 22*b* or 22*c*. This second count is related to the expected movement of the attractive plate 18 and is affected by the gap distance and external forces on the attractive plate 18. Counts on the order of tens of milliseconds or less should be the norm to prevent aver heating of the control coil from the applied power, It is understood that the capacitor 20*c* can be sized to prevent over powering the control coil 20*c* when the current from the voltage conditioner 20*b* is lower than the rated current of the valve of to control coil 16.

The present invention has been described with respect to specific embodiments thereof, it will be understood that various changes and modifications will be suggested to one skilled in the art and it is intended to encompass such changes and modifications as fall within the scope of the appended claims.

What is claimed:

1. An energy efficient and power versatile electro-permanent magnet system for use in a door holder unit for maintaining a door in an open position under no power by magnetically attracting and holding an attractive plate in a plate fixture attracted to said door with said attractive plate and said door released by application of a pulsed current, comprising:

an electro-permanent magnet containing:

a core having an inner and outer pole piece, and an end piece that connects the inner and outer pole pieces to close one end, leaving the other open;

a permanent magnet inside said core that is radially poled from said inner to said outer pole piece; wherein the magnetic flux from said permanent magnet can follow a first direction toward said end piece of said core, or in a second direction toward the open end of said core a control coil inside said core between said inner and said outer pole pieces, and wound about said inner pole piece;

and a pulsed capacitor power and control method for sending a pulsed current to said control coil with said method being power versatile;

where when said attractive plate in the plate fixture is near said open end of said core, the magnetic force from the magnetic flux of said permanent magnet toward the said open end of said core attracts said attractive plate and magnetically latches said attractive plate to said open end of said core with a first magnetic force; or when said attractive plate in the plate fixture is near the open end of said core and said pulsed capacitor power and control method sends a pulsed current to said control coil in a first direction, the magnetic force from the magnetic flux of said permanent magnet toward the open end of said core is increased to attract said attractive plate and magnetically latch said attractive plate to said open end of said core with a second magnetic force higher than said first magnetic force;

where when said attractive plate in the plate fixture is magnetically latched to said core, when said pulsed capacitor power and control method sends a pulse current to said control coil in a second direction, the magnetic flux from the permanent magnet is directed away from said attractive plate and toward the closed end of said core, to reduce the magnetic force that is latching said attractive plate in the plate fixture, whereby said attractive plate in the plate fixture maybe pulled away from said core with little force;

thus to produce an energy efficient and power versatile electro-permanent magnet system by holding open said door under no power and releasing said door with said pulsed current.

2. The energy efficient and power versatile electro-permanent magnet system of claim 1, wherein said control coil in said electro-permanent magnet is composed of two or more coils in parallel.

3. The energy efficient and power versatile electro-permanent magnet system of claim 1, wherein said permanent magnet in said electro-permanent magnet is adjacent said closed end piece of said core and said control coil is adjacent said open end of said core.

4. The energy efficient and power versatile electro-permanent magnet system of claim 1, wherein said permanent magnet in said electro-permanent magnet is adjacent said control coil in said electro-permanent magnet and said open end of said core.

5. The energy efficient and power versatile electro-permanent magnet system of claim 1 having two control coils in parallel in said electro-permanent magnet, wherein said permanent magnet in said electro-permanent magnet is between said two control coils in said electro-permanent.

6. The energy efficient and power versatile electro-permanent magnet system of claim 5, wherein said parallel control coils are independently sent a pulsed current.

7. The energy efficient and power versatile electro-permanent magnet system of claim 1, wherein said pulsed capacitor power and control method is a modification of the BSPMAS in U.S. Pat. No. 9,343,216.

8. The energy efficient and power versatile electro-permanent magnet system of claim 1, wherein there are one or more sensors to tell said pulsed capacitor power and control method when to send a pulse current to said control coil in said electro-permanent magnet.

9. The energy efficient and power versatile electro-permanent magnet system of claim 8, wherein one sensor is an attractive plate proximity device to tell said pulsed capacitor power and control method when to send a pulse current to said control coil in said electro-permanent magnet to increase the magnetic flux toward said open end of said core in said electro-permanent magnet to attract and latch said attractive plate to said core in said electro-permanent magnet.

10. The energy efficient and power versatile electro-permanent magnet system of claim 8, wherein one sensor is a safety device to tell said pulsed capacitor power and control method when to send a pulse current to said control coil in said electro-permanent magnet to unlatch said attractive plate from said open end of said core in said electro-permanent magnet.

11. An energy efficient and power versatile electro-permanent magnet system for use in a door holder unit for maintaining a door in an open position under no power by magnetically attracting and holding an attractive plate in a plate fixture attracted to said door with said attractive plate in the plate fixture and said door released by application of a pulsed current, comprising:

an electro-permanent magnet containing:

a core having an inner and outer pole piece, an end piece that connects said inner and said outer pole pieces to close one end of said core with the other end open, and a low coercivity permanent magnet forming part of said inner pole piece adjacent said end piece;

a control coil inside said core between the inner and outer pole pieces, and wound about said low coercivity permanent magnet;

a high coercivity permanent magnet inside said core between said inner and said outer pole pieces, and wound about said inner pole piece of said core at said open end;

and a pulsed capacitor power and control method for sending a pulsed current to said control coil with said method being power versatile;

where under no current to said control coil, the direction of magnetization between said low and said high coercivity permanent magnets is aligned, to produce a magnetic force at said open end of said core to magnetically latch said attractive plate in the plate fixture to said open end of said core;

where when said attractive plate in the plate fixture is magnetically latched to said core, when said pulsed capacitor power and control method sends a pulse current to said control coil, the direction of magnetization in said high coercivity permanent magnet is switched to cause opposing magnetizations between said low and said high coercivity permanent magnets through the inner pole of said core, the core then produces no net magnetic force on said attractive plate in the plate fixture in the plate fixture, whereby said attractive plate in the plate fixture maybe pulled away from said core with little force;

thus to produce an energy efficient and power versatile electro-permanent magnet system by holding open said door under no power and releasing said door with said pulsed current.

12. The energy efficient and power versatile electro-permanent magnet system of claim 11, wherein said control coil in said electro-permanent magnet is composed of two or more coils in parallel.

13. The energy efficient and power versatile electro-permanent magnet system of claim 11, wherein said pulsed capacitor power and control method is a modification of the BSPMAS in U.S. Pat. No. 9,343,216.

14. The energy efficient and power versatile electro-permanent magnet system of claim 11, wherein there are one or more sensors to tell said pulsed capacitor power and control method when to send a pulse current to said control coil in said electro-permanent magnet.

15. The energy efficient and power versatile electro-permanent magnet system of claim 14, wherein one sensor is an attractive plate proximity device to tell said pulsed capacitor power and control method when to send a pulse current to said control coil in said electro-permanent magnet to increase the magnetic flux toward said open end of said core in said electro-permanent magnet to attract and latch said attractive plate in the plate fixture to said core in said electro-permanent magnet.

16. The energy efficient and power versatile electro-permanent magnet system of claim 14, wherein one sensor is a safety device to tell said pulsed capacitor power and control method when to send a pulse current to said control coil in said electro-permanent magnet to unlatch said attractive plate in the plate fixture from said open end of said core in said electro-permanent magnet.

* * * * *